US008925467B2

(12) United States Patent
Kennedy et al.

(10) Patent No.: US 8,925,467 B2
(45) Date of Patent: Jan. 6, 2015

(54) RAILROAD CAR SEAL FOR RAILROAD HOPPER CARS

(75) Inventors: James S. Kennedy, Zelienople, PA (US); Jon M. Kaufman, Beaver, PA (US); Victoria V. Bowermaster, Pittsburgh, PA (US); James Hill, New Castle, PA (US); Matthew Hill, New Castle, PA (US)

(73) Assignee: A. Stucki Co., Moon Township, PA (US)

( * ) Notice: Subject to any disclaimer, the term of this patent is extended or adjusted under 35 U.S.C. 154(b) by 635 days.

(21) Appl. No.: 13/045,704

(22) Filed: Mar. 11, 2011

(65) Prior Publication Data

US 2011/0227297 A1 Sep. 22, 2011

Related U.S. Application Data

(60) Provisional application No. 61/313,318, filed on Mar. 12, 2010.

(51) Int. Cl.
*B61D 3/00* (2006.01)
*B61D 7/22* (2006.01)

(52) U.S. Cl.
CPC ..... *B61D 7/22* (2013.01)
USPC ..... 105/282.2

(58) Field of Classification Search
USPC ..... 105/280–282.2
See application file for complete search history.

(56) References Cited

U.S. PATENT DOCUMENTS 3,807,318 A * 4/1974 Chierici ..... 105/282.2

* cited by examiner

*Primary Examiner* — R. J. McCarry, Jr.
(74) *Attorney, Agent, or Firm* — Buchanan Ingersoll & Rooney PC

(57) ABSTRACT

A seal is disclosed for retrofitting to an existing railroad hopper car having opposing sidewalls and at least one trough extending between the opposing sidewalls. The seal includes a first member configured to mate against a surface of a trough adjacent a sidewall, the first member including a first edge having angled sections corresponding to angled sections of where the sidewall meets the trough, and a second member integral with the first member and extending substantially upright from the first edge of the first member, the second member configured to mate against a surface of the sidewall adjacent the trough, wherein the second member is angled relative to the first member at each of the angled sections corresponding to angled sections of the sidewall adjacent the trough.

16 Claims, 9 Drawing Sheets

RAILROAD CAR SEAL FOR RAILROAD HOPPER CARS

CROSS-REFERENCE TO RELATED APPLICATIONS

This application claims the benefit of co-pending Provisional Patent Application Ser. No. 61/313,318 entitled "Urethane Seal Utilized for Railroad Coal Cars", filed on Mar. 12, 2010, the entire disclosure of which is incorporated by reference herein.

FIELD OF THE INVENTION

The present invention is directed toward seals for railroad cars and, more particularly, toward a seal for retrofitting to an existing railroad hopper cars such as, but not limited to, coal and other mineral cars.

BACKGROUND OF THE INVENTION

Coal is the single largest commodity by volume that is transported by the North American railroads. Typically, the utility companies implement multiple unit trains consisting of approximately 100 (or more) open-top hopper cars that continuously run from the mines to the power plants to provide a continuous supply of coal. In fact, the railroads are the most efficient and cost effective means to haul the coal. However, the utility companies, and other coal purchases, are constantly looking for ways to increase their productivity and lower their costs by hauling more coal per unit train. Utility companies, and others, have been able to accomplish this by, among other things, adding additional cars to the unit train, increasing the gross rail load per car permitted by the Association of American Railroads ("AAR"), and by converting the open-top hopper cars from steel to aluminum.

Unfortunately, despite these efforts, it has been discovered that there is an increasing amount of coal being lost as it is transported from the mines to the power plants. A portion of this loss is due to spillage at the loading and unloading facilities and/or by aerodynamic effects as the car travels down the tracks at speeds of up to 70 mph. Typically, the level of the loaded coal will be above the top of the open-top hopper car and, thus, some coal particles will be blown off as the car travels down the tracks. However, a fairly substantial portion of the loss is a result of gaps that exist in the railroad car structure itself. One such gap typically exists between the sidewall and trough (floor) of the hopper car, which gap can be as large as ½" or more and can result in a loss of approximately 200 to 500 pounds of coal per car per trip, depending, of course, on the size of the gap and the size of the coal loaded into the car. Beyond the obvious loss of revenue and efficiencies, this has also resulted in the degradation of the track ties and substructure, as the sulfur in the spilled coal combines with rain water to create sulfuric acid, which eats away at the track ties and substrate.

Previous attempts to fix or close these gaps have not met with much success. One attempted method has been to apply caulk to fill the gaps. However, the caulk is generally not strong enough to form a good seal, especially where the gap is appreciable. Since the railroad cars have, for the most part, been converted to aluminum, welding is therefore an issue and is thus not a preferred means of sealing any gaps.

Any seal will also need to withstand the forces and pressures associated with the loading and unloading of coal or other minerals into and out of the railroad car. Additionally, the seal needs to be resistant to sulfuric acid to prevent the seal from deteriorating over time, especially if the seal is used in a railroad car that transports primarily coal.

The present invention is directed toward overcoming one or more of the above-identified problems.

SUMMARY OF THE INVENTION

A seal according to the present invention is provided for retrofitting to an existing railroad hopper car having opposing sidewalls and at least one trough extending between the opposing sidewalls. The inventive seal includes a first member configured to mate against a surface of a trough adjacent a sidewall, and a second member integral with the first member and extending substantially upright from an edge of the first member, the second member configured to mate against a surface of the sidewall adjacent the trough, wherein the first and second members substantially cover a gap between the sidewall and the trough.

The first member includes a generally flat first member having first angled sections corresponding to angled sections of where the sidewall meets the trough. The second member includes second angled sections corresponding to angled sections of the sidewall adjacent the trough.

At least one of the first and second members includes apertures formed therein for receiving bolts to attach the seal to the railroad hopper car. Alternately, at least one of the first and second members can include means, such as an adhesive, etc., for attaching the seal to the railroad hopper car.

Preferably, the first and second members are made of a polyurethane material. However, they may be made of other materials, such as, aluminum, steel, injection molded plastic, etc.

The first and second members generally include top, middle and bottom angled sections corresponding to top, middle and bottom angled sections of where the sidewall meets the trough. The second member is angled relative to the first member at the top, middle and bottom angled sections corresponding to top, middle and bottom angled sections of the sidewall adjacent the trough.

To provide optimum sealing performance, the angle between the first and second members is approximately 80°-110° at the top angled section (approximately 95° preferred), the angle between the first and second members is approximately 110°-150° at the middle angled section (approximately 125° preferred), and the angle between the first and second members is approximately 80°-110° at the bottom angled section (approximately 95° preferred).

The first and second members include surfaces that mate with the trough and sidewall, respectively. At least one of the surfaces of the first and second members that mate with the trough and sidewall surfaces, respectively, can include at least one cut out section for accommodating an existing fastener connecting the railroad hopper car together.

In a further form, a seal according to the present invention is provided for retrofitting to an existing railroad hopper car having opposing sidewalls and at least one trough extending between the opposing sidewalls. The inventive seal includes first and second members integrally formed with each other and having a generally "L" shaped cross-section, the first member configured to mate against a surface of a trough adjacent a sidewall, and the second member configured to mate against a surface of the sidewall adjacent the trough, wherein the first and second members include angled sections corresponding to angled sections of where the sidewall meets the trough, and wherein the second member is angled relative to the first member at each of the angled sections corresponding to angled sections of the sidewall adjacent the trough, wherein the first and second members substantially cover a gap between the sidewall and the trough.

In a preferred form, the first and second members are made of a polyurethane material. However, the first and second members, and hence the seal, may be made of other materials, such as, aluminum, steel, injection molded plastic, etc.

To attach the seal to the railroad car, at least one of the first and second members includes apertures formed therein for receiving bolts there through. Alternately, at least one of the first and second members can include means, such as an adhesive, etc., for attaching the seal to the railroad hopper car.

The angled sections of the first and second members include top, middle and bottom angled sections corresponding to top, middle and bottom angled sections of where the sidewall meets the trough, and wherein the second member is angled relative to the first member at the top, middle and bottom angled sections corresponding to top, middle and bottom angled sections of the sidewall adjacent the trough.

To provide optimum sealing performance, the angle between the first and second members is approximately 80°-110° at the top angled section (approximately 95° preferred), the angle between the first and second members is approximately 110°-150° at the middle angled section (approximately 125° preferred), and the angle between the first and second members is approximately 80°-110° at the bottom angled section (approximately 95° preferred).

To allow for a secure retrofit, the first and second members include surfaces that mate with the trough and sidewall, respectively, with at least one of the surfaces of the first and second members that mate with the trough and sidewall surfaces, respectively, including at least one cut out section for accommodating an existing fastener connecting the railroad hopper car together.

In yet a further form, a seal according to the present invention is provided for retrofitting to an existing railroad hopper car having opposing sidewalls and at least one trough extending between the opposing sidewalls. The inventive seal includes a first member configured to mate against a surface of a trough adjacent a sidewall, the first member including a first edge having angled sections corresponding to angled sections of where the sidewall meets the trough, and a second member integral with the first member and extending substantially upright from the first edge of the first member, the second member configured to mate against a surface of the sidewall adjacent the trough, wherein the second member is angled relative to the first member at each of the angled sections corresponding to angled sections of the sidewall adjacent the trough, wherein the first and second members substantially cover a gap between the sidewall and the trough.

The angled sections of the first edge of the first member include top, middle and bottom angled sections corresponding to top, middle and bottom angled sections of where the sidewall meets the trough, and wherein the second member is angled relative to the first member at the top, middle and bottom angled sections corresponding to top, middle and bottom angled sections of the sidewall adjacent the trough.

To provide optimum sealing, the angle between the first and second members is approximately 80°-110° at the top angled section (approximately 95° preferred), the angle between the first and second members is approximately 110°-150° at the middle angled section (approximately 125° preferred), and the angle between the first and second members is approximately 80°-110° at the bottom angled section (approximately 95° preferred).

At least one of the first and second members includes apertures formed therein for receiving bolts to attach the seal to the railroad hopper car.

In a preferred form, the first and second members, and hence the seal, are made of a polyurethane material.

For retrofitting purposes, the first and second members include surfaces that mate with the trough and sidewall, respectively, and wherein at least one of the surfaces of the first and second members that mate with the trough and sidewall surfaces, respectively, include at least one cut out section for accommodating an existing fastener connecting the railroad hopper car together.

It is an object of the present invention to provide a seal for railroad hopper cars to seal the gap between the sidewalls and troughs to prevent coal or other minerals being transported from falling there through.

It is another object of the present invention to provide a seal for railroad hopper cars that has excellent low temperature properties.

It is yet another object of the present invention to provide a seal for railroad hopper cars that has high abrasion resistance.

It is still another object of the present invention to provide a seal for railroad hopper cars that has outstanding hydrolytic stability.

It is a further object of the present invention to provide a seal for railroad hopper cars that has high resilience.

It is yet a further object of the present invention to provide a seal for railroad hopper cars that is resistant to sulfuric acid and antifreeze.

It is still a further object of the present invention to provide a seal for railroad hopper cars that has high resilience balanced with resistance to sulfuric acid and antifreeze.

Other objects, aspects and advantages of the present invention can be obtained from a study of the specification, the drawings, and the appended claims.

DETAILED DESCRIPTION OF THE INVENTION

Figure 1:
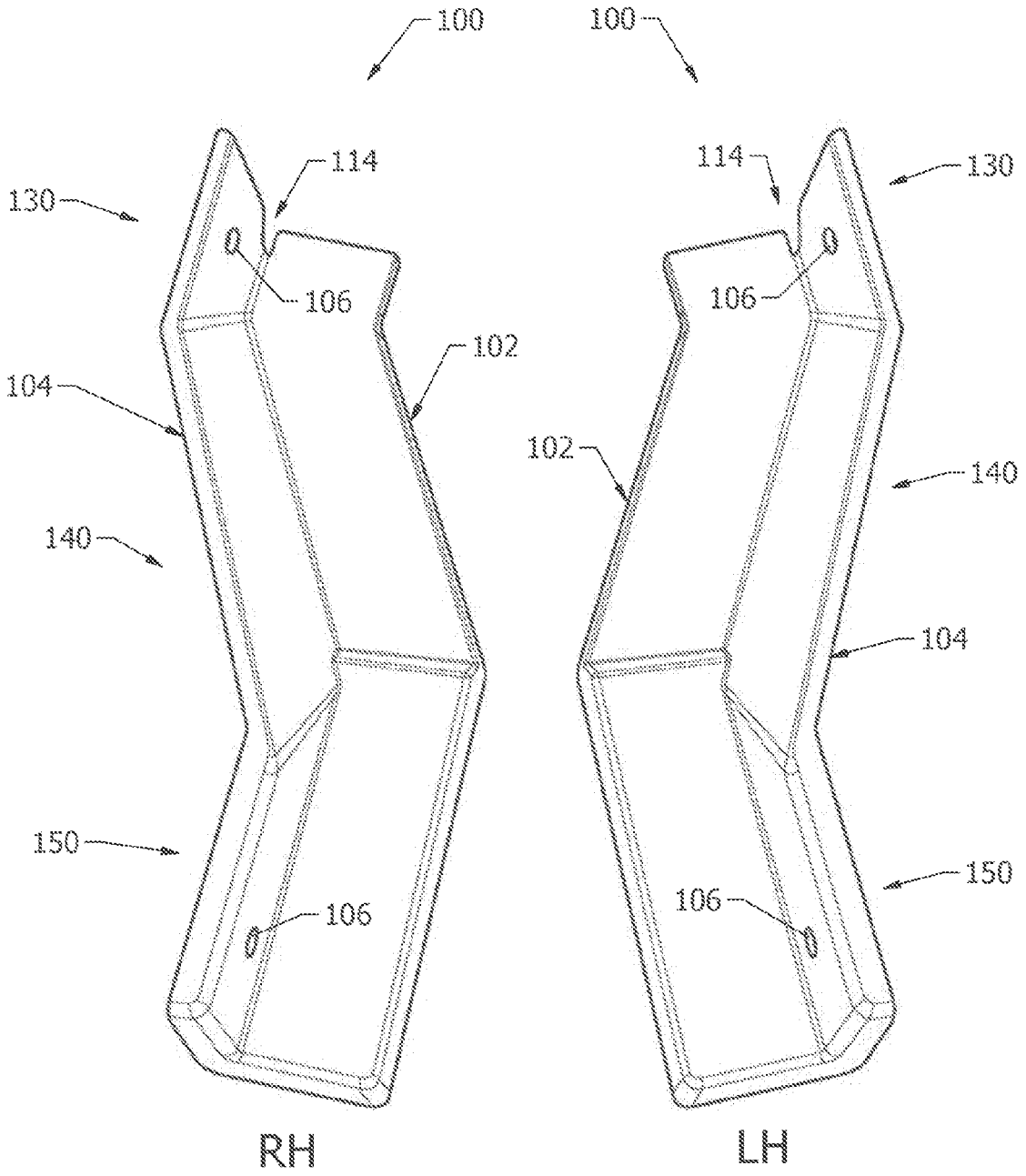
FIG. 1 is a top perspective view of two seals according to the present invention.

To overcome the coal loss identified above due to gaps in the car structure, an elastomeric angle has been developed to provide a seal between the sidewall and floor/trough of these railroad cars to minimize the loss of coal as it is transported from the mines to the power plants. The typical railroad hopper car will include opposing endwalls 10 attached to opposing sidewalls 12, to form a generally rectangular frame (see FIGS. 12-13). The floor of the railroad car generally includes a plurality of troughs 14, which are used to unload the coal or other mineral. The troughs 14 extend between the sidewalls 12 and include angled pieces which extend downward to pivoting doors 16. To load the railroad car, the doors 16 are pivoted to the closed position and secured shut via a latch or other commonly known methods. After the loaded train reaches its destination, it is unloaded by simply opening the doors 16. The coal, or other minerals, will flow out of the openings via gravitational forces to unload the railroad car.

As previously noted, during transport of the coal (or other minerals) an increasing amount of coal is lost at the gap 80 between the sidewall 12 and the trough 14. The inventive seal, shown generally at 100, is designed for attachment at this gap 80 to close off the gap 80 and prevent the loss of coal there though (see FIGS. 11-12).

Referring to FIGS. 1-10, the inventive seal 100 can be cast as a linear angle that is flexible enough to contour to the exact railroad car geometry at the sidewall 12 and trough 14 junctions. It is likely that the preferred embodiment is an angle that is manufactured to the shape of the railroad car body and fastened into place. The seal 100 includes a first member 102 that is configured to mate with the trough 14 adjacent the sidewall 12, and a second member 104 integrally formed with the first member 102 and extending generally upright from an edge of the first member 102. The first 102 and second 104 members have generally an "L" shaped cross-section along the length of the seal 100. The seal 100 may be formed as a left-hand LH seal or a right-hand RH seal, depending upon which side of the trough to which the seal 100 will be attached. The left-hand LH and right-hand RH seals 100 are mirror images of each other, and the description herein pertains to both. The left-hand LH and right-hand RH orientations are determined by standing in the trough opening and looking at the sidewall 12. Identifying indicia may be molded into the seals 100 to aid in installation.

The seal 100 includes a top angled section 130, a middle angled section 140, and a bottom angled section 150, which corresponds to top 230, middle 240 and bottom 250 angled sections at the junction of where the sidewall 12 meets the trough 14. Since the trough 14 is generally flat, the bottom surface of the first member 102 is generally flat so that it is configured to mate against the surface of the trough 14. Since the sidewall 12 has a varying shape at the sidewall/trough junction, the seal 100 includes similarly angled sections. For example, the sidewall 12 includes a top wall 12*a* that is generally vertically oriented, a middle angled wall 12*b* angled toward the interior of the railroad car, and a bottom wall 12*c* that is generally vertically oriented. The top 130, middle 140 and bottom 150 angled sections of the seal 100 are angled to correspond to the top 230 (where the top wall 12*a* meets the trough 14), middle 240 (where the angled wall 12*b* meets the trough 14) and bottom 250 (where the bottom wall 12*c* meets the trough 14) sections of where the sidewall 12 meets the trough 14.

Additionally, the first 102 and second 104 members are angled relative to each other at the top 130, middle 140 and bottom sections 150 to correspond with the angle between the sidewall 12 and the trough 14 at the top 230 (where the top wall 12*a* meets the trough 14), middle 240 (where the angled wall 12*b* meets the trough 14) and bottom 250 (where the bottom wall 12*c* meets the trough 14) sections thereof. As shown more clearly in FIGS. 5-10, the angle between the first 102 and second 104 members at the top section 130 is preferably between 80°-110°, and is more preferably approximately 95° (see e.g., FIGS. 5 and 8). The angle between the first 102 and second 104 members at the middle section 140 is preferably between 110°-150°, and is more preferably approximately 125° (see e.g., FIGS. 7 and 10). The angle between the first 102 and second 104 members at the bottom section 150 is preferably between 80°-110°, and is more preferably approximately 95° (see e.g., FIGS. 6 and 9).

The seal 100 is preferably manufactured with an angle greater than that of the geometry established by the railroad car body sidewall 12 relative to the floor/trough 14 to create a force-fit which will provide a tighter sealing surface along the edges and accommodate variations in the geometry of the railroad car. For example, if the angle between the sidewall 12 and the floor/trough 14 is approximately 90° (which is typically the case at the top 230 and bottom 250 sections), the angle between the first 102 and second 104 members of the seal 100 at the top 130 and bottom 150 sections will be made approximately 95° (see e.g., FIGS. 5, 8 and 6, 9). Similarly, if the angle between the sidewall 12 and the floor/trough 14 is approximately 120° (which is typically the case at the middle section 240), the angle between the first 102 and second 104 members of the seal 100 at the middle section 140 will be made approximately 125° (see e.g., FIGS. 7 and 10). As should be apparent, in one form of the present invention it is contemplated herein to make the angle between the first 102 and second 104 members approximately 5° larger than the corresponding angle between the sidewall 12 and the trough 14. However, other angle dimensions can be implemented without departing from the spirit and scope of the present invention.

One skilled in the art will appreciate that the angles recited herein are exemplary only, and the inventive seal 100 may include other angles between the first 102 and second 104 members at the various sections, as well as other angled sections of the seal itself, to accommodate the various geometries at the intersection of the sidewall and trough in various railroad cars.

In a preferred form, the seal 100 is attached at only one member, or side, to the railroad car. As shown in FIGS. 1-13, the second member 104 includes apertures 106 formed therein. The apertures 106 are designed to receive bolts (not shown) for attaching the seal 100 to the sidewall 12 of the railroad car. The seal 100 can be attached by either using an existing fastener, if that is possible, to simplify installation, or by drilling holes through the sidewall 12 of the railroad car to accommodate the bolts. The force of the other member 102, or side, pressing against the railroad car trough 14 due to the greater angle of the seal 100 will maintain the gap 80 closed and sealed to prevent coal from falling there through.

Figure 11:
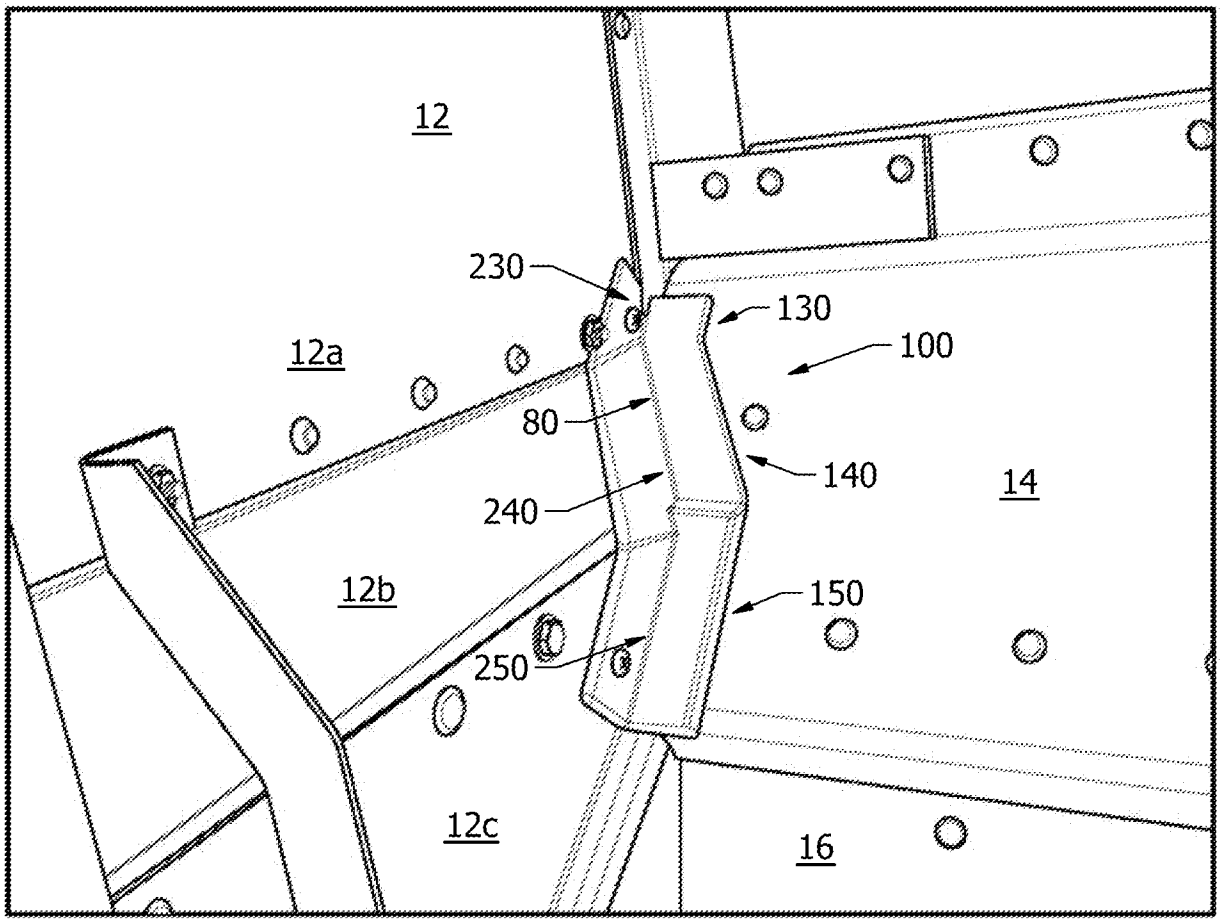
FIG. 11 is a perspective view of the inventive seal attached to the railroad car sidewall and trough.
Figure 12:
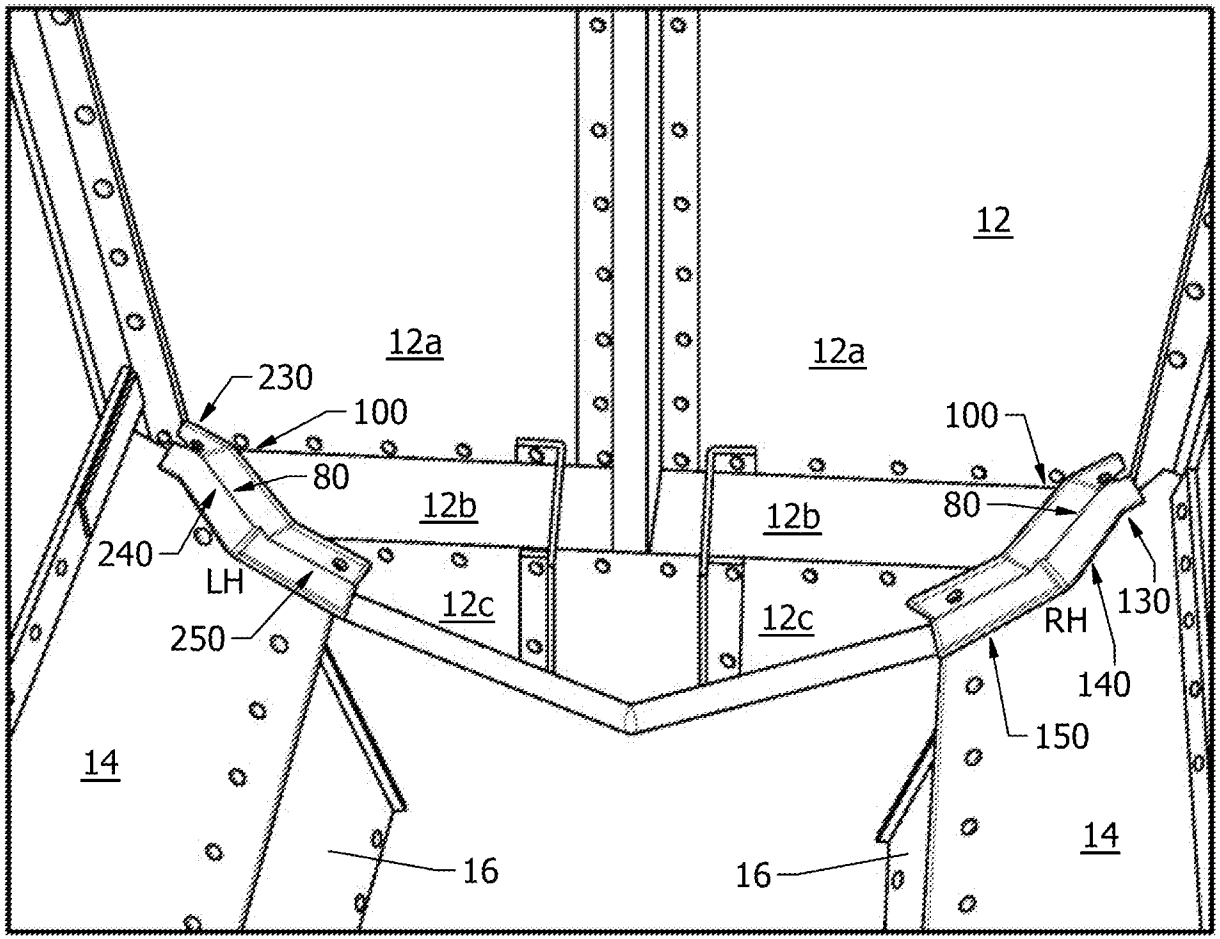
FIG. 12 is a perspective view of two seals according to the present invention attached to the railroad car sidewall and trough at one end of the trough.
Figure 13:
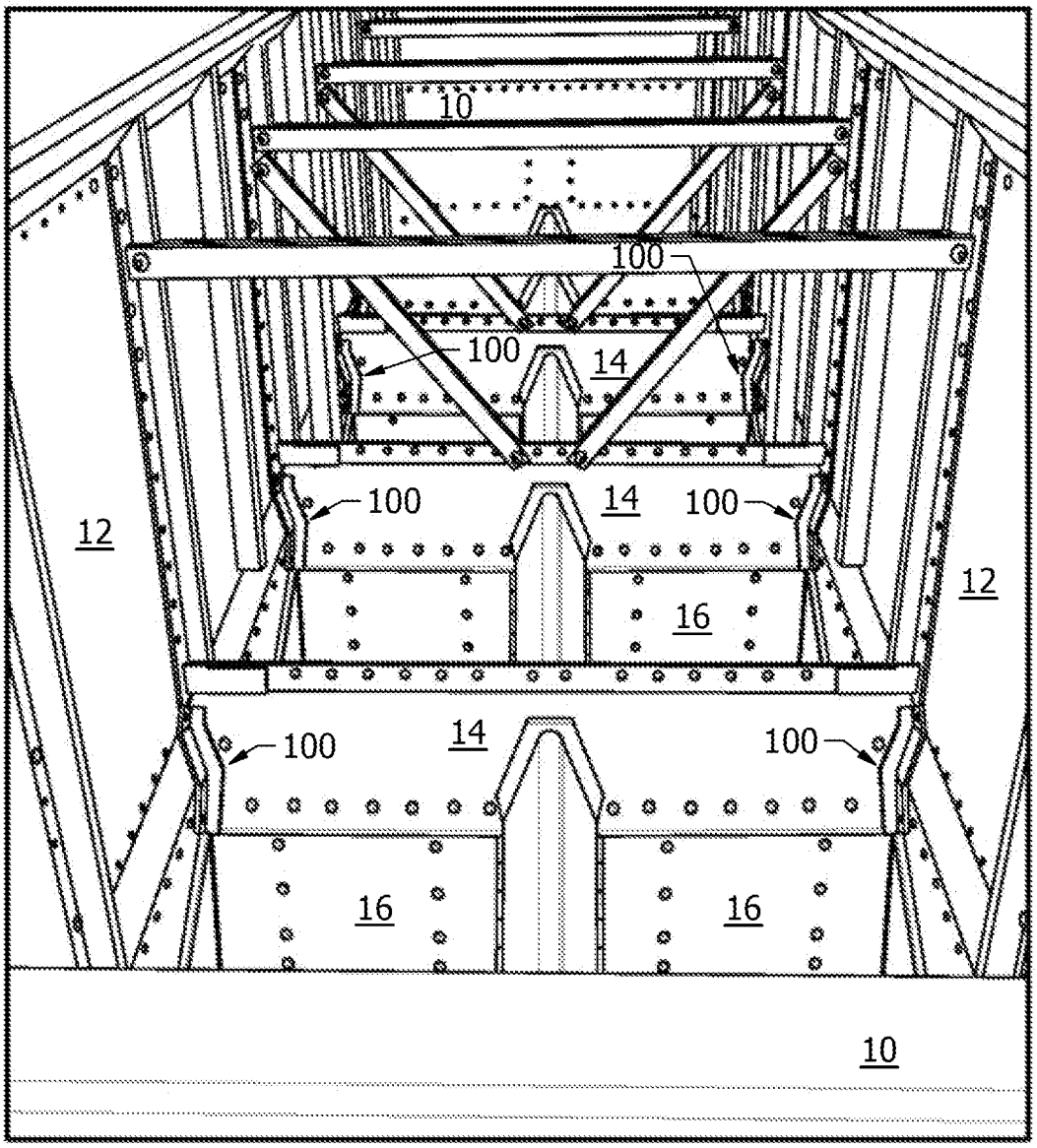
FIG. 13 is a perspective view of the inside of a railroad hopper car showing the inventive seals attached at the gap between the sidewalls and troughs.

In a preferred form, the inventive seal 100 is attached, or fastened, only on the surface (i.e., second member 104) mating to the sidewall 12 of the railroad car (see FIGS. 11-13). This will help prevent failure of the seal 100 as the railroad car expands and contracts due to, for example, temperature or loading conditions. As previously described, due to the first 102 and second 104 members of the seal 100 having an angle greater than that of the geometry established by the railroad car body sidewall 12 relative to the floor/trough 14, the side of the seal 100 mating with the floor/trough (i.e., the first member 102) will be biased against the floor/trough 14 to close off the gap 80. However, one skilled in the art will appreciate that the seal may be attached at either the first 102 or second 104 members, or both, without departing from the spirit and scope of the present invention.

Washers, inserts (metallic or non-metallic), or other supporting structures (not shown) may be added or manufactured integrally to with the aperture 106 to support and strengthen the apertures 106 to prevent stretching, tearing and/or failure of the seal 100 during installation and/or service.

While the inventive seal 100 has been described herein as bolted to the railroad car body, alternative attachment methods, such as adhesives, etc., may be utilized to attach the seal 100 to the railroad car body for simplicity, reliability, ease of installation, etc., without departing from the spirit and scope of the present invention.

Figure 2:
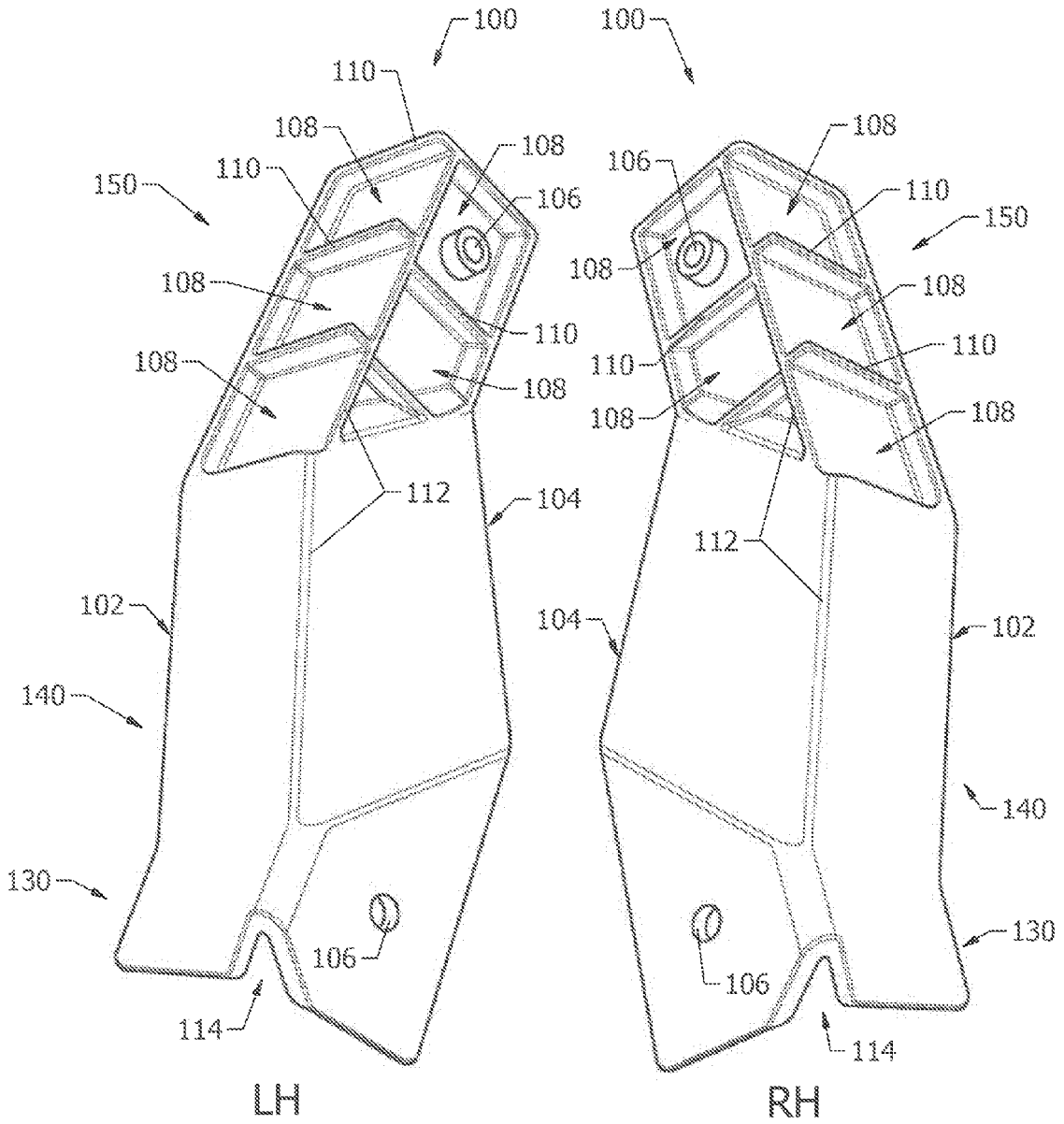
FIG. 2 a bottom perspective view of two seals according to the present invention.
Figure 3:
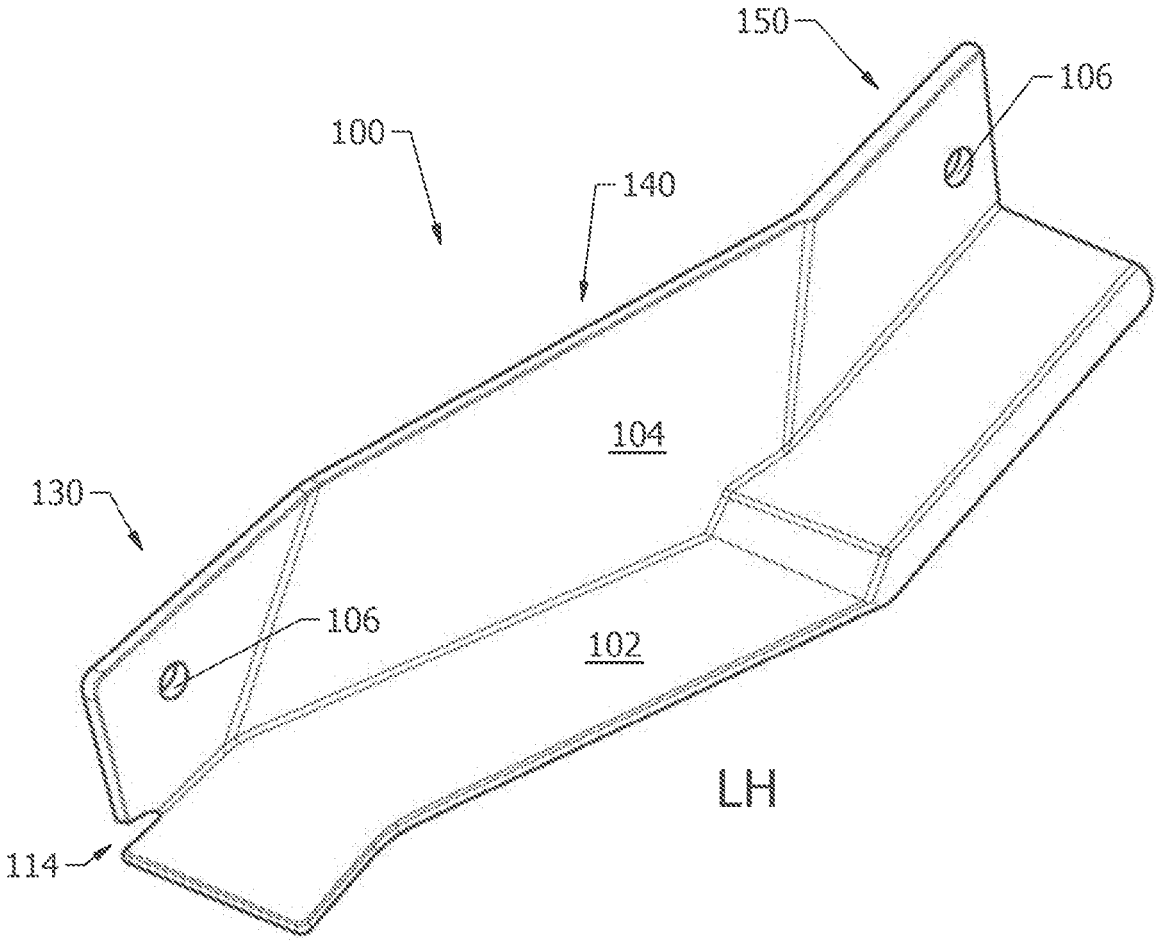
FIG. 3 is a front perspective view of a seal according to the present invention for attachment to the left-hand side of the railroad car trough.
Figure 4:
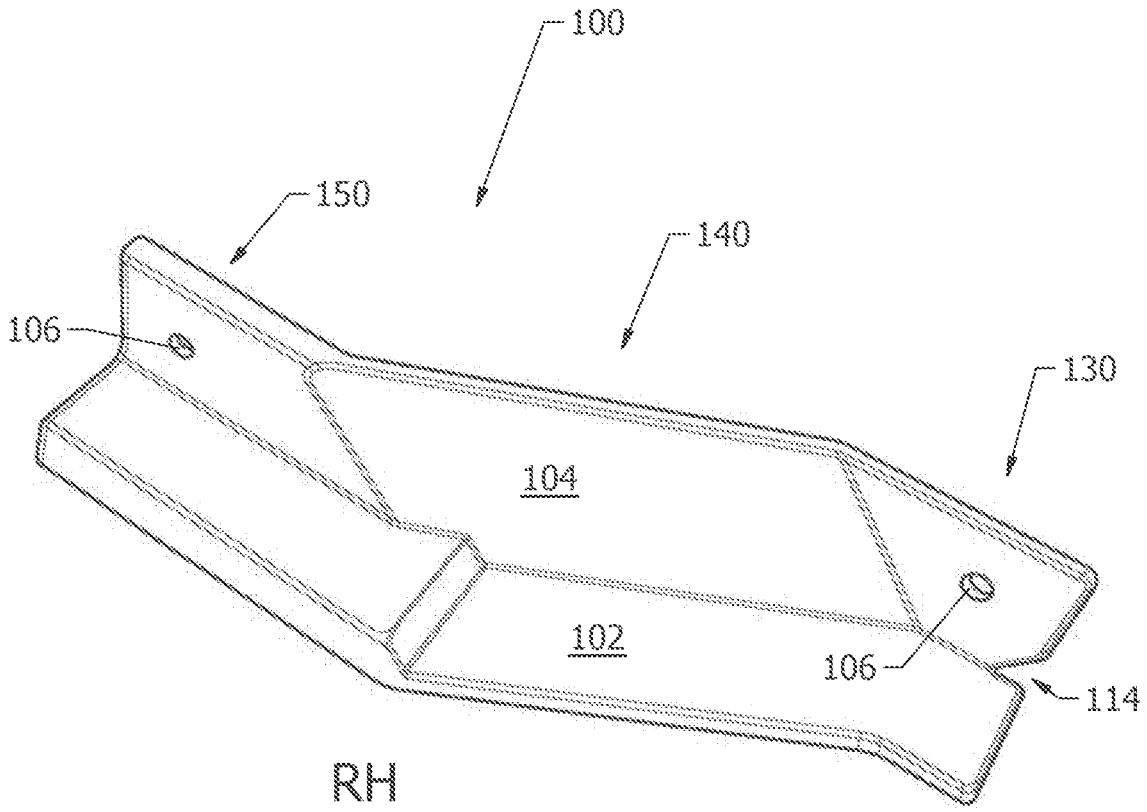
FIG. 4 is a front perspective view of a seal according to the present invention for attachment to the right-hand side of the railroad car trough.
Figure 5:
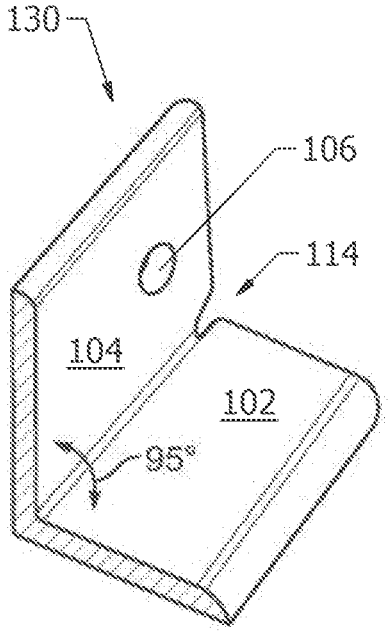
FIGS. 5-10 are cross-sectional and cross-sectional perspective views taken at various sections of the inventive seal.
Figure 6:
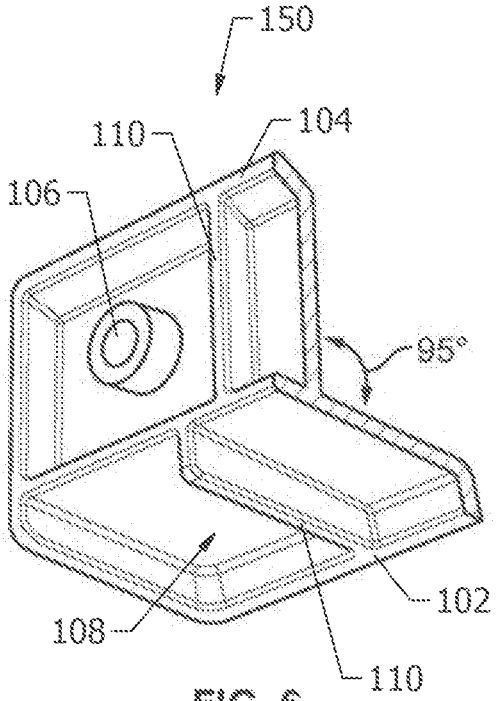
Figure 7:
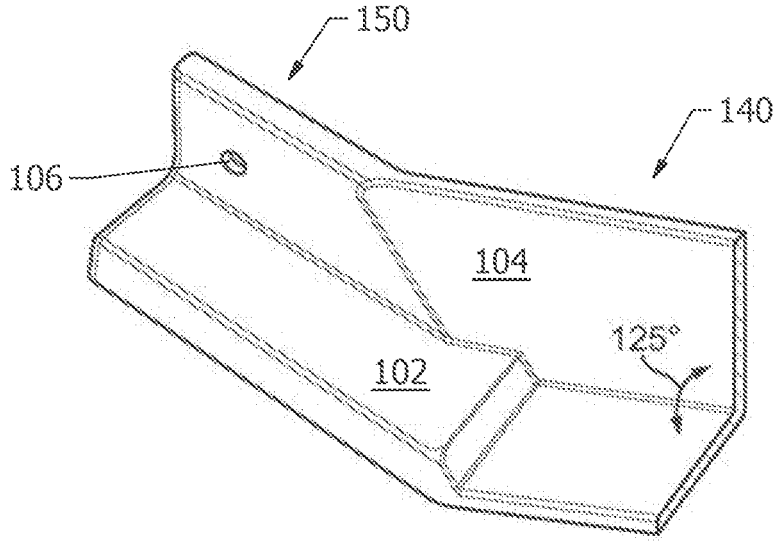
Figure 8:
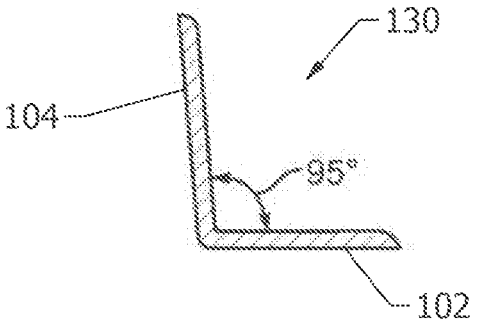
Figure 9:
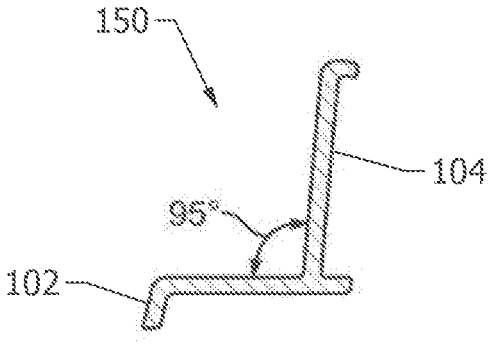
Figure 10:
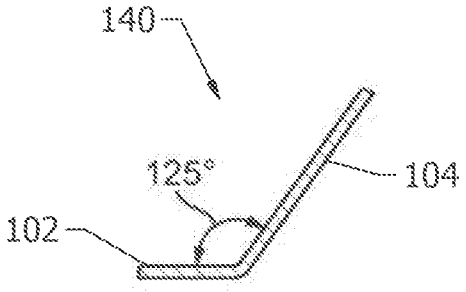

Rather than create clearance holes in the seal 100 for existing fasteners on the railroad car structure, which is an option, the inventive seal 100 may incorporate clearance pockets 108 (see FIG. 2). As shown in FIG. 2, the bottom surfaces of the first 102 and second 104 members include clearance pockets 108 cut out therein, which are designed to accommodate existing fasteners on the railroad car to enable the first 102 and second 104 members to sit flat against the sidewall 12 and trough 14 surfaces, respectively. This will improve the sealing and provide the best fit with existing surfaces. The clearance pockets 108 are designed to provide room for the bolt heads of existing fasteners on the railroad car and provide a tight fit without having to create clearance holes in the seal 100 for the existing fasteners. The ribs 110, which are provided on the bottom surfaces of the first 102 and second 104 members, aid in defining the clearance pockets 108, also aid in providing strength and additional rigidity to the seal 100. FIG. 2 shows the clearance pockets 108 formed only at the bottom section 150 of the seal 100. This is because the existing construction of railroad cars dictates where the clearance pockets 108 should be formed. The clearance pockets 108 may be formed at any of the top 130, middle 140 and/or bottom 150 sections of the seal 100 to provide room for the bolt heads of existing fasteners on the railroad car without departing from the spirit and scope of the present invention.

The seal 100 is preferably made of a 90 Shore A MDI polyether material to provide excellent low temperature properties, high abrasion resistance, outstanding hydrolytic stability, and high resilience balanced with resistance to sulfuric acid and antifreeze, which are common requirements for railroad car equipment. In a preferred form, the seal 100 is made of TEXIN® 260, a thermoplastic polyurethane elastomer (polyester) manufactured by Bayer MaterialScience LLC. However, other polyether and similar materials may be utilized.

Additionally, the seal 100 may be made of other alternative materials, such as, but not limited to, aluminum, steel, injection molded plastic (polyethylene or other similar materials), other elastomers, etc., to provide particular advantages, such as, but not limited to, increased chemical resistance, simplified installation or manufacturing, longevity, lower cost, etc. Further, special additives or a higher durometer urethane may be chosen for the seal 100 to improve chemical resistance, abrasion resistance, etc. over the proposed 90 Shore A MDI polyether urethane.

A radius 112 is preferably applied to the "spine" or bottom edge of the seal 100 that will fill the gap 80 to prevent interference and to accommodate variations in the geometry of the railroad car (see FIG. 2). Typically, a sharp corner is not desired at the bottom edge of the seal 100, since the gap 80 distance and overall geometry of the railroad car will vary. Rounding off the bottom edge corner, i.e., applying a radius 112, will allow the inventive seal 100 to accommodate various gaps 80 and various railroad car geometries while providing a good fit to keep the gap 80 sealed off and closed.

The inventive seal 100 preferably incorporates a notch 114, or other visual indicator, to identify the top section 130, or surface, and orient the seal 100 properly for installation (see e.g., FIGS. 1 and 11-13). Additionally, as shown more clearly in FIG. 11, the notch 114 aids in proper installation of the seal 100 by serving the function of avoiding another panel of the railroad car sidewall 12 body. This allows for a better fit of the seal 100 and, thus, better sealing. The thickness of the inventive seal 100 can be approximately ⅛" to ½". However, other thicknesses are contemplated for optimal performance in various applications. The edge of the inventive seal 100 may be beveled to a taper or radius, so that the edges of the seal 100 do not form a lip protruding from the railroad car. Any protruding lip may catch against the coal or other minerals loaded into the car and cause the seal 100 to become dislodged or tear. Ribs, inserts, and other support structures may be added to, or cast into, the seal 100 at optimal placement to provide additional strength and/or rigidity, if necessary. Additionally, the inventive seal 100 may be made of any color as performance, product identification, or customer preference may dictate.

One skilled in the art will appreciate that while the inventive seal 100 has been described herein for use in sealing off the gap 80 between the sidewall 12 and trough 14 of a railroad car designed for transporting coal and/or other minerals, the inventive urethane seal 100 may be utilized in other areas of the coal/mineral car, and may also be beneficial to preventing loss of commodities in other railroad freight vehicles and cars.

While the present invention has described herein with particular reference to the drawings, it should be understood that various modifications could be made without departing from the spirit and scope of the present invention. Those skilled in the art will appreciate that various other modifications and alterations could be developed in light of the overall teachings of the disclosure. The presently preferred embodiments described herein are meant to be illustrative only and not limiting as to the scope of the invention which is to be given the full breadth thereof.

We claim:

1. A seal for retrofitting to an existing railroad hopper car having opposing sidewalls and at least one trough extending between the opposing sidewalls, the seal comprising:

a first member configured to mate against a surface of a trough adjacent a sidewall; and a second member integral with the first member and extending substantially upright from an edge of the first member, the second member configured to mate against a surface of the sidewall adjacent the trough, wherein the first and second members substantially cover a gap between the sidewall and the trough, wherein the first and second members include top, middle and bottom angled sections extending from a first end to a second end and angled in a plane of the first member and corresponding to top, middle and bottom angled sections of where the sidewall meets the trough, and wherein the second member is angled relative to the first member at the top, middle and bottom angled sections corresponding to top, middle and bottom angled sections of the sidewall adjacent the trough, and wherein the angle between the first and second members is approximately 80°-110° at the top angled section, wherein the angle between the first and second members is approximately 110°-150° at the middle angled section, and wherein the angle between the first and second members is approximately 80°-110° at the bottom angled section.

2. The seal of claim 1, wherein the first member comprises a generally flat first member having first angled sections corresponding to angled sections of where the sidewall meets the trough.

3. The seal of claim 2, wherein the second member includes second angled sections corresponding to angled sections of the sidewall adjacent the trough.

4. The seal of claim 1, wherein at least one of the first and second members includes apertures formed therein for receiving bolts to attach the seal to the railroad hopper car.

5. The seal of claim 1, wherein at least one of the first and second members includes means for attaching the seal to the railroad hopper car.

6. The seal of claim 1, wherein the first and second members comprise a polyurethane material.

7. The seal of claim 1, wherein the first and second members include surfaces that mate with the trough and sidewall, respectively, and wherein at least one of the surfaces of the first and second members that mate with the trough and sidewall surfaces, respectively, include at least one cut out section for accommodating an existing fastener connecting the railroad hopper car together.

8. A seal for retrofitting to an existing railroad hopper car having opposing sidewalls and at least one trough extending between the opposing sidewalls, the seal comprising:

first and second members integrally formed with each other and having a generally "L" shaped cross-section, the first member configured to mate against a surface of a trough adjacent a sidewall, and the second member configured to mate against a surface of the sidewall adjacent the trough, wherein the first and second members include angled sections corresponding to angled sections of where the sidewall meets the trough, and wherein the second member is angled relative to the first member at each of the angled sections corresponding to angled sections of the sidewall adjacent the trough, wherein the first and second members substantially cover a gap between the sidewall and the trough, wherein the angled sections of the first and second members include top, middle and bottom angled sections extending from a first end to a second end and angled in a plane of the first member and corresponding to top, middle and bottom angled sections of where the sidewall meets the trough, and wherein the second member is angled relative to the first member at the top, middle and bottom angled sections corresponding to top, middle and bottom angled sections of the sidewall adjacent the trough, and wherein the angle between the first and second members is approximately 80°-110° at the top angled section, wherein the angle between the first and second members is approximately 110°-150° at the middle angled section, and wherein the angle between the first and second members is approximately 80°-110° at the bottom angled section.

9. The seal of claim 8, wherein the first and second members comprise a polyurethane material.

10. The seal of claim 8, wherein at least one of the first and second members includes apertures formed therein for receiving bolts to attach the seal to the railroad hopper car.

11. The seal of claim 8 wherein at least one of the first and second members includes means for attaching the seal to the railroad hopper car.

12. The seal of claim 8, wherein the first and second members include surfaces that mate with the trough and sidewall, respectively, and wherein at least one of the surfaces of the first and second members that mate with the trough and sidewall surfaces, respectively, include at least one cut out section for accommodating an existing fastener connecting the railroad hopper car together.

13. A seal for retrofitting to an existing railroad hopper car having opposing sidewalls and at least one trough extending between the opposing sidewalls, the seal comprising:

a first member configured to mate against a surface of a trough adjacent a sidewall, the first member including a first edge having angled sections corresponding to angled sections of where the sidewall meets the trough; and a second member integral with the first member and extending substantially upright from the first edge of the first member, the second member configured to mate against a surface of the sidewall adjacent the trough, wherein the second member is angled relative to the first member at each of the angled sections corresponding to angled sections of the sidewall adjacent the trough, wherein the first and second members substantially cover a gap between the sidewall and the trough, wherein the angled sections of the first edge of the first member include top, middle and bottom angled sections extending from a first end to a second end and angled in a plane of the first member and corresponding to top, middle and bottom angled sections of where the sidewall meets the trough, and wherein the second member is angled relative to the first member at the top, middle and bottom angled sections corresponding to top, middle and bottom angled sections of the sidewall adjacent the trough, and wherein the angle between the first and second members is approximately 80°-110° at the top angled section, wherein the angle between the first and second members is approximately 110°-150° at the middle angled section, and wherein the angle between the first and second members is approximately 80°-110° at the bottom angled section.

14. The seal of claim 13, wherein at least one of the first and second members includes apertures formed therein for receiving bolts to attach the seal to the railroad hopper car.

15. The seal of claim 13, wherein the first and second members comprise a polyurethane material.

16. The seal of claim 13, wherein the first and second members include surfaces that mate with the trough and sidewall, respectively, and wherein at least one of the surfaces of the first and second members that mate with the trough and sidewall surfaces, respectively, include at least one cut out section for accommodating an existing fastener connecting the railroad hopper car together.

* * * * *